US006505427B1

(12) United States Patent
Sterling et al.

(10) Patent No.: US 6,505,427 B1
(45) Date of Patent: Jan. 14, 2003

(54) DISPLAY APPARATUS

(75) Inventors: Paul Sterling, Pretoria; Ignace M G J Van Goethem, Linksfield North, both of (ZA)

(73) Assignee: Media Communication Investment, Limited, Douglas (GB)

( * ) Notice: Subject to any disclaimer, the term of this patent is extended or adjusted under 35 U.S.C. 154(b) by 0 days.

(21) Appl. No.: 09/529,689

(22) PCT Filed: Oct. 14, 1998

(86) PCT No.: PCT/GB98/03090

§ 371 (c)(1),
(2), (4) Date: Apr. 14, 2000

(87) PCT Pub. No.: WO99/19859

PCT Pub. Date: Apr. 22, 1999

(30) Foreign Application Priority Data

Oct. 15, 1997 (ZA) ..... 97/9214

(51) Int. Cl.[7] ..... G09F 11/32
(52) U.S. Cl. ..... 40/508; 40/467; 40/512
(58) Field of Search ..... 40/446, 466, 467, 40/470, 508, 509, 512, 511

(56) References Cited

U.S. PATENT DOCUMENTS 422,570 A * 3/1890 Connett ..... 40/511
3,568,345 A * 3/1971 Grosse ..... 40/511
3,616,556 A * 11/1971 Williams ..... 40/511
4,240,219 A * 12/1980 Tornqvist ..... 40/476
4,901,460 A * 2/1990 Grosse ..... 40/476
5,253,438 A * 10/1993 Norizuki et al. ..... 40/511
5,276,987 A * 1/1994 Honse ..... 40/511
5,543,856 A * 8/1996 Rosser et al. ..... 348/578
5,574,519 A * 11/1996 Manico et al. ..... 396/429
5,806,659 A * 9/1998 Middelberg et al. ..... 198/731
6,060,993 A * 5/2000 Cohen ..... 340/691.6
6,169,498 B1 * 1/2001 King et al. ..... 340/999

* cited by examiner

*Primary Examiner*—Lynne H. Browne
*Assistant Examiner*—Kenn Thompson
(74) *Attorney, Agent, or Firm*—Antonelli, Terry, Stout & Kraus, LLP

(57) ABSTRACT

A display apparatus includes a chassis frame and a housing. The housing defines a storage compartment with an inlet and an outlet for storing a plurality of display envelopes in a substantially parallel configuration. Two endless drive belts are located over corresponding pairs of roller spaced away from each other at opposing ends of the chassis frame. The endless belts each have a silicon-coated bearings face and a corresponding undulating wave spring secured to the chassis frame for urging the bearing faces of the drive belt against the surface of a display envelope while located in the presentation area. The drive belts are operable to draw the display envelope along a predetermined trajectory through the presentation area and into the inlet of the storage compartment. Fluorescent lighting is mounted on the chassis for back-lighting a display envelope while positioned in the presentation area, and each envelope is fitted with leading and trailing hook formation to enable successive display envelopes to be drawn through the outlet of the storage compartment.

27 Claims, 13 Drawing Sheets

DISPLAY APPARATUS

FIELD OF THE INVENTION

This invention relates to an apparatus for the storage and displaying of advertising material and, more specifically, to an apparatus for the storage and presentation of back-lit advertisement carriers. The invention extends to a system for facilitating billing of advertisers whose advertising material is presented in the display apparatus.

BACKGROUND TO THE INVENTION

Devices are known for the presentation of advertising posters within pockets, consisting of two transparent flexible sheets joined together at their edges to form display envelopes. The display envelopes are stored in a chamber in a substantially parallel orientation and are drawn individually from the storage chamber by a drive device to a presentation position where the display envelopes are back-lit and displayed for viewing, for a predetermined time period. The display envelope is then moved by the drive mechanism out of the presentation area and returned to the storage compartment whilst a subsequent display envelope is moved into position in the presentation area.

Such devices are disclosed in PCT Patent Application No. 96/30888 and PCT Patent Application No. 93/04616.

U.S. Pat. No. 5,276,987 discloses a display system in which transparent image-bearing sheets are transported through a viewing apparatus and positioned in a backbit viewing window. The sheets are stored in a compartment behind the viewing window and are individually transported from the storage compartment to the viewing window and back to the storage compartment by a chain entrained on a pathway through the display system. Each sheet is suspended in the storage compartment from corresponding rod which is engaged in the chain for transportation of the sheet to the viewing window.

PCT Patent Application WO 96/30888 relates to a similar display system for presenting advertising posters in a back-lit presentation area. The posters are moved out of a storage compartment into the presentation area and returned to the storage compartment by a drive mechanism consisting of a motor-driven endless belt.

French Patent No. 2.717.602 teaches a display apparatus in which advertising posters are displayed sequentially in a presentation area. Each advertising poster may be displayed in the presentation area for a predetermined time determined by an identification code carried by the poster. The display apparatus includes a facility for reading and decoding the identification code on each poster.

U.S. Pat. No. 5,389,993 relates to an apparatus for displaying any one of a number of backdrops for use in a photographic studio. The backdrops are carried on a continuous roll, the ends of which are connected to different shafts. The shafts are motor driven to allow automated scrolling of the different backdrops for display. Sensors are provided to detect the position of the continuous roll and a processor allows automated movement of the roll from one backdrop to another.

These patents disclose various mechanisms for drawing the display envelopes into the presentation area, such as tractor feed mechanisms or friction based drives. A common problem with these prior art embodiments is that they lack reliability and consequently do not provide sustained error-free operation.

A further problem with advertising apparata of this type is difficult that of providing accurate billing to advertisers due to the fact that it is difficult to assess the amount of exposure given to an advertiser's material on account of the unreliability of the devices themselves. Furthermore, it is difficult to provide the advertiser with an itemised account of the actual times that his advertising material has been displayed.

OBJECT OF THE INVENTION

It is an object of this invention to provide a display apparatus and a system for displaying advertising material which will, at least partially, alleviate the above-mentioned difficulties.

SUMMARY OF THE INVENTION

In accordance with this invention, there is provided a display apparatus, including:

- a chassis frame and a housing defining a storage compartment for storing a plurality of display envelopes in a substantially parallel configuration, the storage compartment having an inlet and an outlet;
- drive means for drawing a display envelope along a predetermined trajectory through a presentation area and into the inlet of the storage compartment;
- lighting means for back-lighting the display envelope whilst positioned in the presentation area; and
- engagement means for sequentially drawing successive display envelopes through the outlet of the storage compartment characterised in that the drive means Includes at least one endless drive belt locatable over a pair of rollers spaced away from each other at opposing ends of the chassis frame, the endless belt having a bearing face, and at least one spring secured to the chassis frame for urging the bearing face of the endless drive belt against the surface of the display envelope whilst located at least partially in the presentation area.

Further the invention provides for the at least one spring to be an undulating leaf spring, for the drive means to include two endless drive belts in a parallel configuration arranged to bear on opposing ends of the display envelopes in a direction parallel to an intended direction of travel of the display envelope, for the bearing faces of the endless drive belts to be silicon-coated, for the drive means to include a pressure equalisation assembly for equalising the pressure applied by the bearing faces of the drive belts on the opposing ends of the display envelope, for the pressure equalisation assembly to be a cable secured to the chassis frame and connected at either end to a corresponding one of the undulating leaf springs, and for the cable to be co-operable with a tensioner.

Still further features of the invention provide for the engagement means to be hook formations located on operatively leading and trailing edges, respectively, of the display envelopes relative to the intended direction of travel, and for the trailing hook of a display envelope to engage the leading hook of an adjacent display envelope as it passes through the outlet of the storage compartment.

Yet further features of the invention provide for the display apparatus to include disengagement means for disengaging the leading and trailing hooks of successive display envelopes upon entry to the storage compartment through the inlet thereof, for the disengagement means to include an elongate spring member of substantially arcuate cross section locatable at the inlet to the storage compartment, the spring member being adapted to deflect the display envelopes and to cause disengagement of the engaged leading and trailing hooks of successive display envelopes.

Preferably, the storage compartment is curved In the vicinity of the outlet to cause the leading edges of a plurality of display envelopes in the storage compartment to be held in a fanned-out configuration, one of the rollers is driven by a motor, the motor is an electric motor, and the lighting means is a plurality of fluorescent tubes located on an operatively front wall of the storage compartment.

The invention extends to a display envelope for use with the display apparatus described above, the display envelope including two rectangular sheets of a flexible transparent antistatic material ultrasonically welded together at opposing ends, and having a leading and a trailing hook secured, respectively, to the welded ends of the envelope.

The invention extends further to a system for displaying advertising material, comprising:

at least one display apparatus adapted to sequentially position a plurality of display envelopes containing the advertising material in a presentation area for a predetermined period of time, each display envelope bearing a unique identification code;

a reader for reading the unique identification code on a display envelope when it is positioned in the presentation area;

a real time clock: and storage means for storing the unique identification code of each display envelope when it is positioned in the presentation area, and the length of time for which it is present in the presentation area.

There is also provided for the unique identification code to indicate the identity of an advertiser whose advertising material is contained in the display envelope, for the identification code to represent the time period for which the display envelope is to be displayed in the presentation area, for the identification code to be a bar code, and for the reader to be a bar code scanner.

There is further provided for the display apparatus to include a sound facility, for the unique identification code to selectively initiate the playing of an advertising jingle through the sound facility when the display envelope is positioned in the presentation area, and for the sound facility to be a speaker.

There is still further provided for the display apparatus to include a communication bus for downloading the stored information to a billing facility for preparing itemised bills for advertisers whose advertising material is displayed in the display apparatus, for the system to include a portable storage facility connectable to the communication bus for storing the downloaded information, the storage facility being, in turn, connectable to the billing facility for transferring the downloaded information thereto, and for the billing facility to be a computer.

BRIEF DESCRIPTION OF THE DRAWINGS

One embodiment of the invention is described below, by way of example only, and with reference to the accompanying drawings in which.

DETAILED DESCRIPTION OF THE INVENTION

Figure 1:
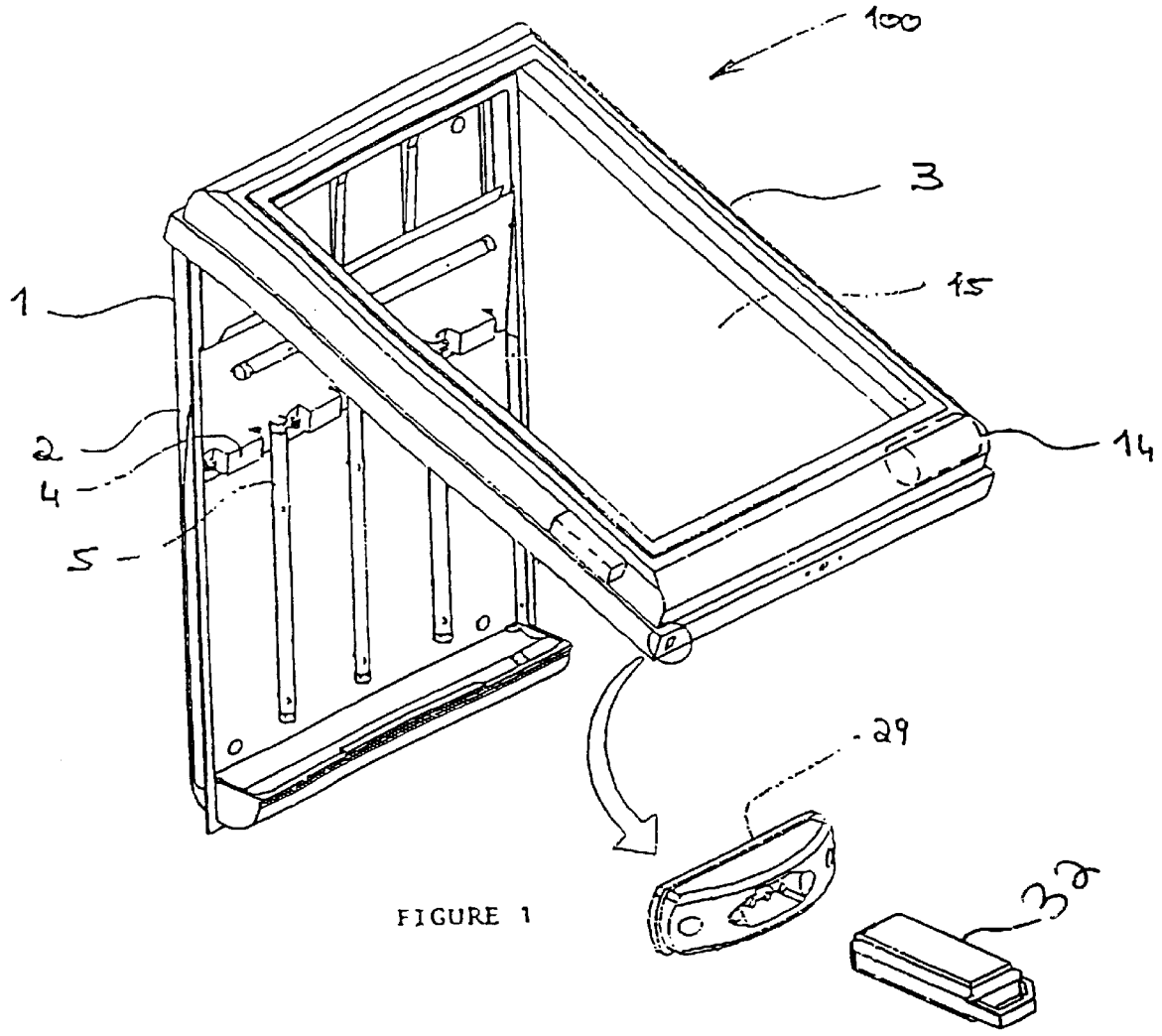
FIG. 1 is a perspective view of a display apparatus according to the invention.
Figure 2:
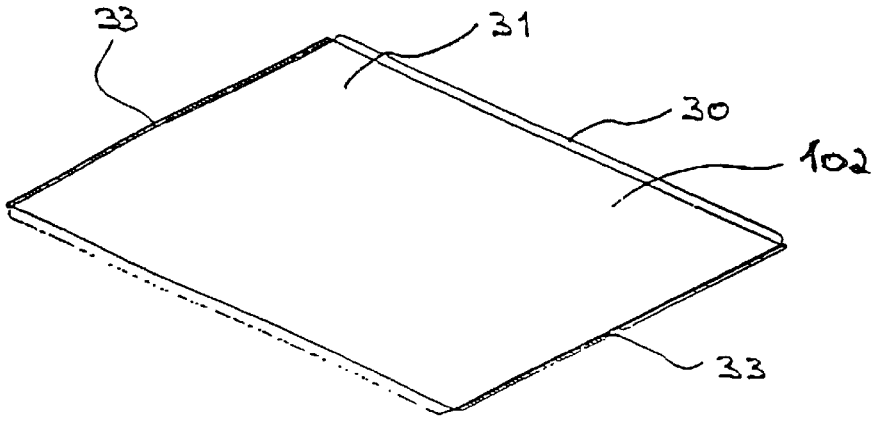
FIG. 2 is a perspective view of a display envelope for use in the display apparatus of FIG. 1.
Figure 3:
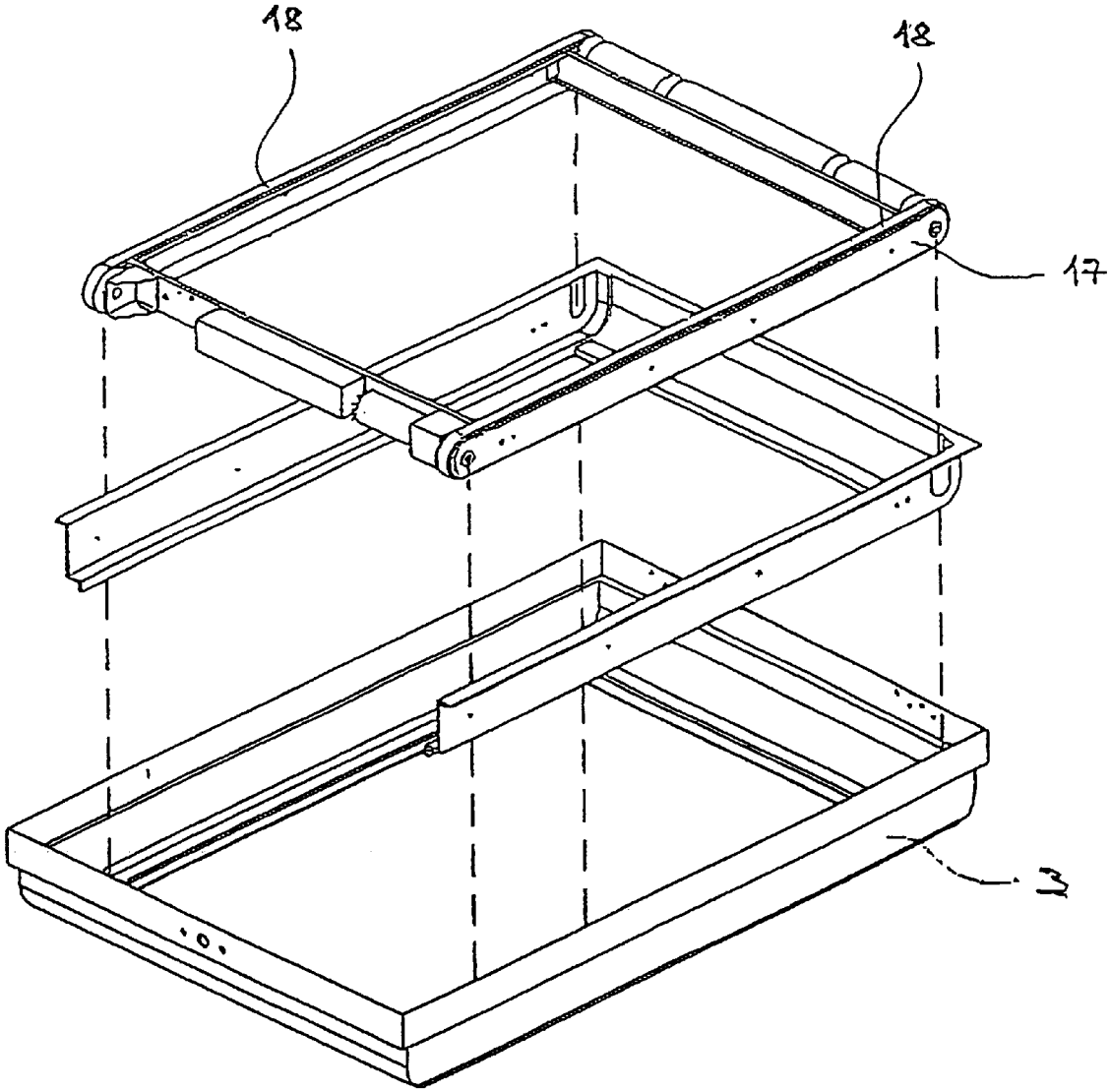
FIG. 3 is an exploded view of a chassis frame of the display apparatus of FIG. 1.
Figure 4:
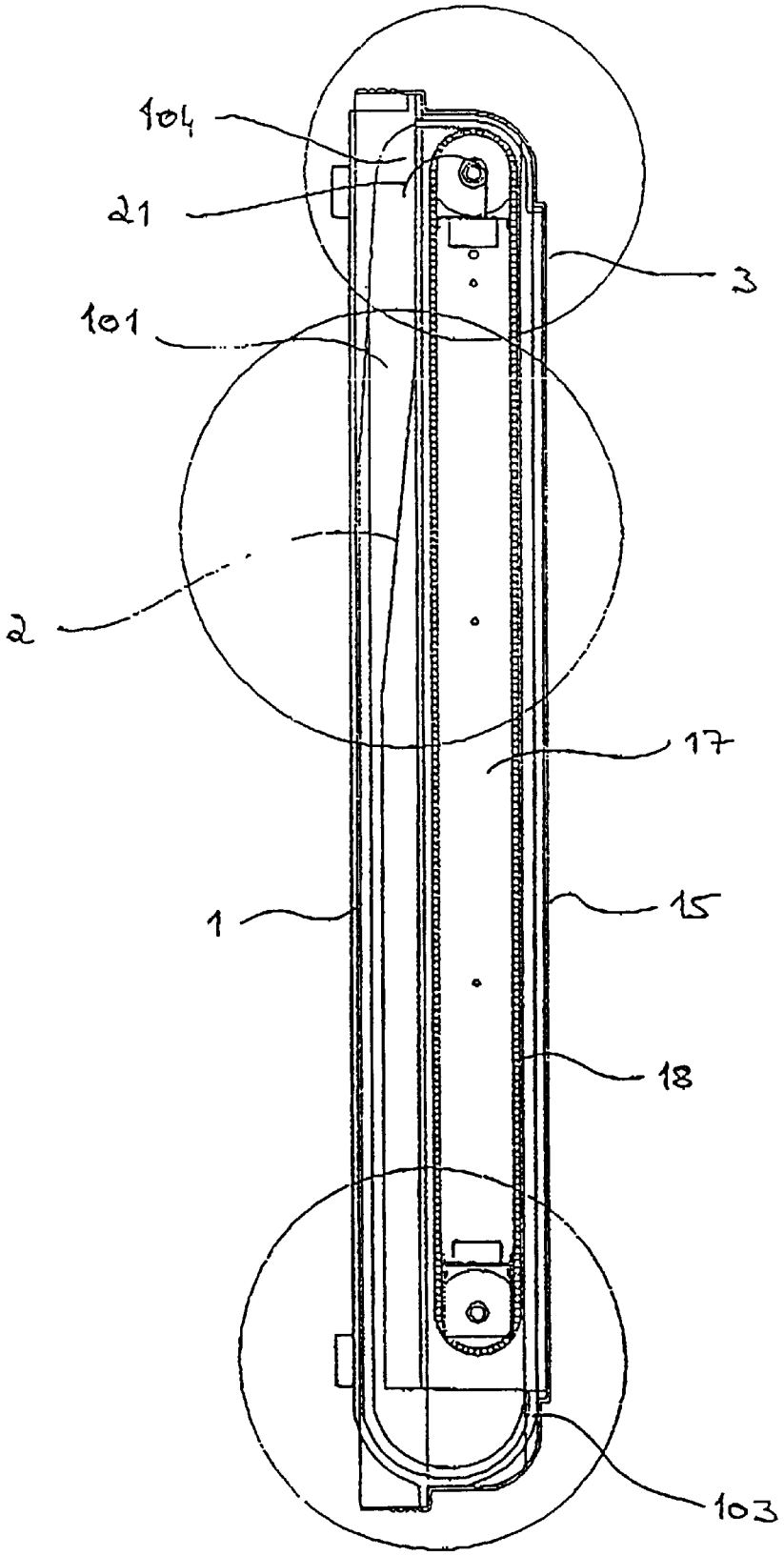
FIG. 4 is a sectional side view of the display apparatus of FIG. 1

Referring to FIGS. 1 to 14, in which like features of the invention are indicated by like numerals, a display apparatus is indicated generally by reference numeral (100).

The display apparatus (100) comprises a rectangular chassis frame (17) enclosed by a rectangular front cover (3) and a rectangular rear cover (1). The front cover (3) is hingedly connected at one end to the chassis frame (17) and is pivotable relative to the chassis to open operatively upwardly when the display apparatus is in use. A bulkhead (2) is secured to the chassis frame (17) adjacent the front cover (3).

The front cover (3) has a rectangular opening (15) defining a display position for displaying advertising material therein as will be described later. Lighting means in the form of fluorescent tubes (5) and associated ballasts (4) are mounted on the bulkhead in alignment with the presentation area (15) to provide back-lighting for advertising material presented in the presentation area.

The chassis frame (17), the bulkhead (2) and the rear cover (1) combine to define a storage compartment (101) for storing a plurality of display envelopes (102) therein. A display envelope (102) is illustrated in greater detail in FIG. 2 of the accompanying drawings.

Drive means in the form of two endless drive belts (18) provide propulsion for drawing a presentation envelope (102) out of the storage compartment (101) past the presentation area (15) on the front cover and back into the storage compartment (101). The storage compartment (101) has an outlet (103) shown in greater detail in FIG. 5 and an inlet (104) which is represented in greater detail in FIGS. 7*a* and 7*b*.

The endless drive belts (18) are located over corresponding pairs of rollers at opposing ends of the chassis frame (17) and are thereby not visible through the presentation area (15) in the front cover of the display apparatus (100). The endless drive belts (18) are driven by an electric motor (14) acting on one of the rollers.

Figure 9:
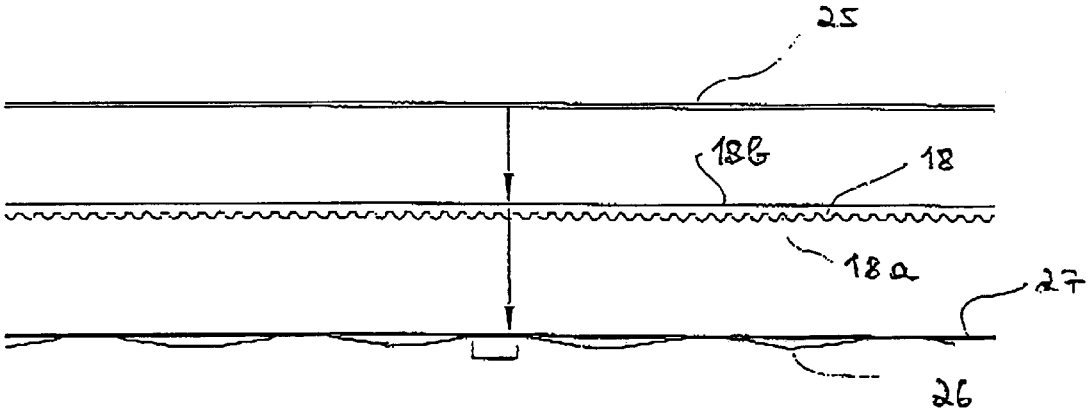
FIG. 9 is a truncated sectional view of the drive belt of FIG. 8, shown in an exploded configuration.
Figure 8:
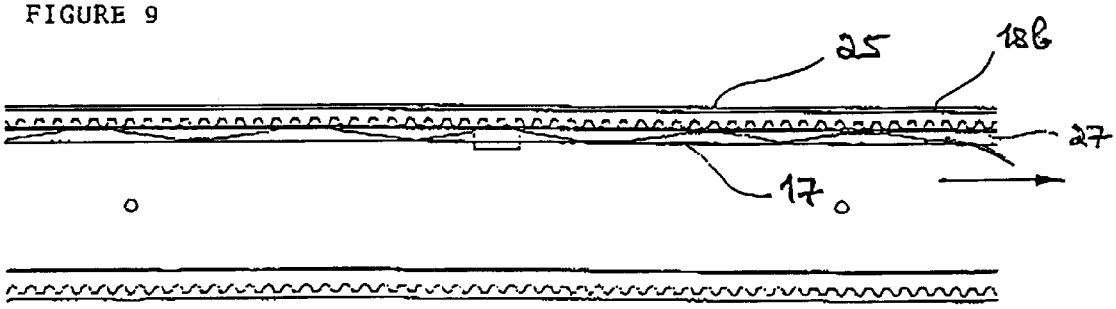
FIG. 8 is a truncated sectional view of a drive belt and leaf spring system of the display apparatus of FIG. 1.

Referring now to FIGS. 8 and 9, the operatively inner surface (18*a*) of the drive belt (18) is toothed whilst the operatively outer surface thereof is coated with a layer of silicon (25) providing a bearing face to the drive belt. Two undulating leaf springs (26) are secured to the chassis frame (17) and act on a drive belt backing plate (27) to cause the silicon bearing face (18*b*) of the drive belt (18) to bear against the surface of a display envelope (102) which is located at least partially in the presentation area (15) of the display apparatus (100).

It will be appreciated by those skilled in the art that movement of the drivebelts (18) will cause the display envelope (102) to move as well. In order to obtain a positive drive on the display envelope (102), the undulating leaf springs (26) must urge the drive belts (18) against the surface of the display envelope with sufficient pressure to prevent slippage of the silicon-coated bearing faces (18*b*) of the drive belts relative to the display envelope.

Figure 10:
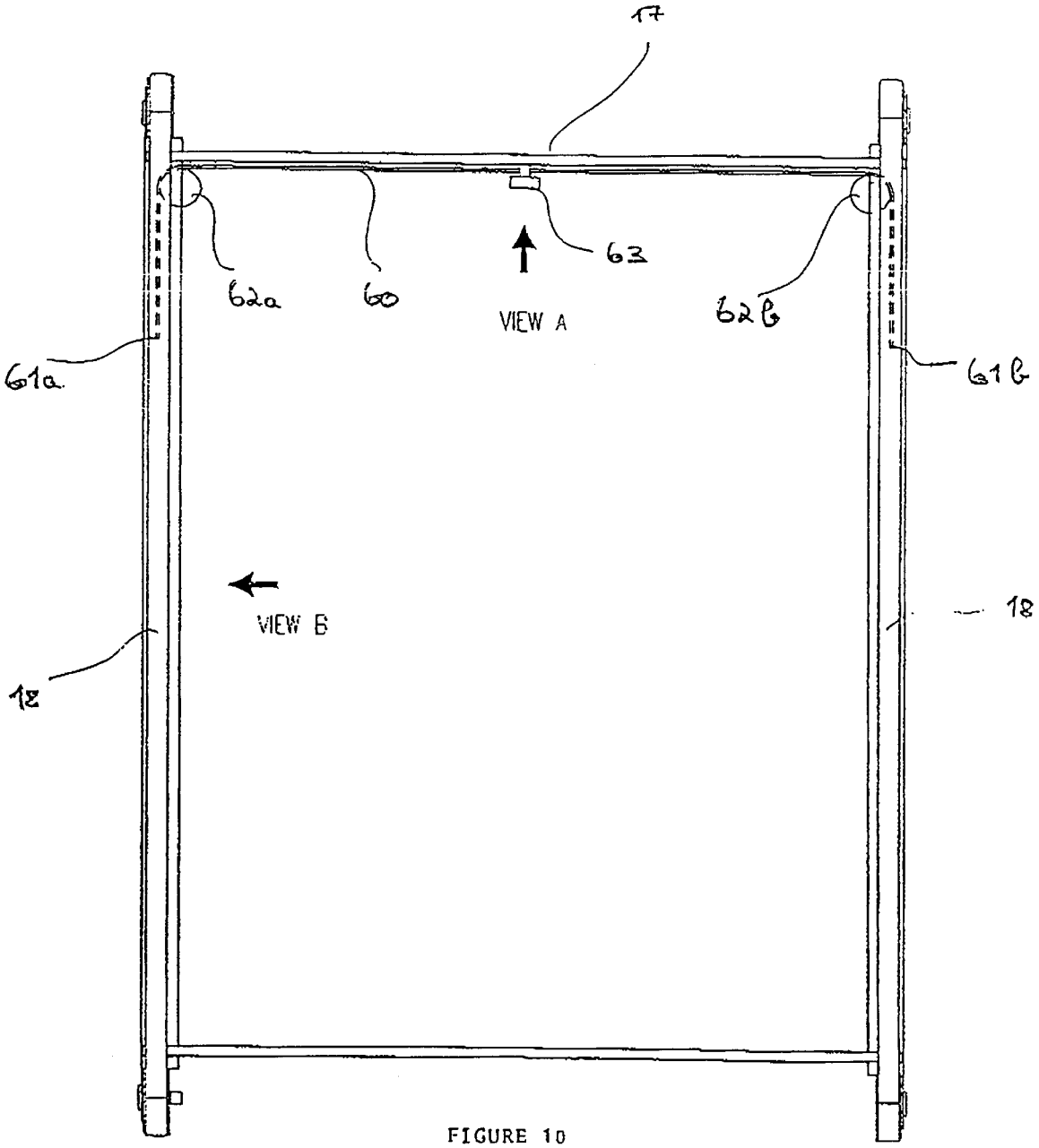
FIG. 10 is an elevation of a pressure equalisation assembly of the display apparatus of FIG. 1.
Figure 12:
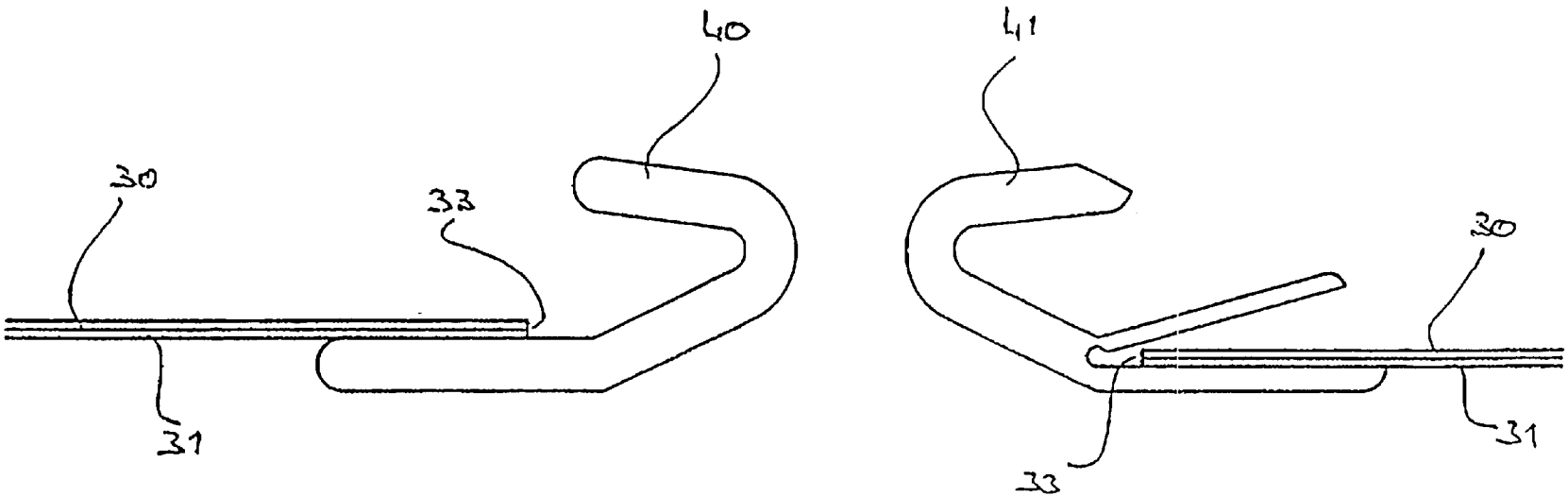
FIG. 12 is a side view of the leading and trailing hooks of the display envelope of FIG. 2 shown in conjunction with the flexible sheets of the display envelope.
Figure 13:
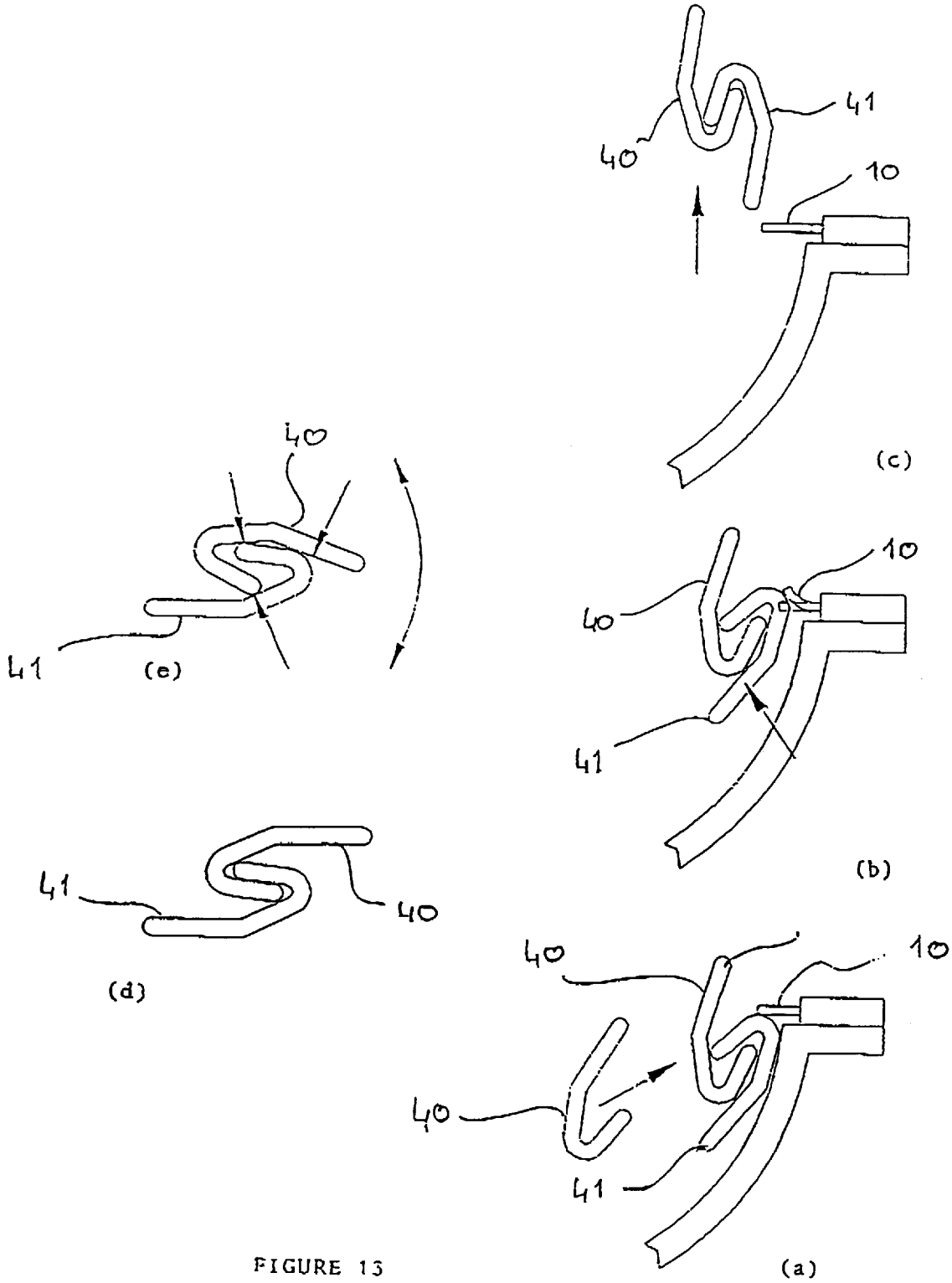
FIGS. 13*a* to 13*e* are sequential representations of engagement of the leading and trailing hooks of two sequential display envelopes at the outlet of the storage compartment of the display apparatus of FIG. 1.

It is also essential that both drive belts (18) apply equal pressure to the display envelopes (102). In order to achieve this a pressure equalisation assembly is provided as indicated in FIG. 10. The pressure equalisation assembly comprises a cable (60) which is connected at either end (61*a* and 61*b*) to a corresponding one of the undulating leaf springs (not shown). The cable (60) is secured to the frame (17) by two pulleys (62*a* and 62*b*) and passes through a tensioner (63) rotatably fastened to the frame (17). The tensioner (63) has a slot (64) therein to accommodate the cable (60). The tensioner (63) can be rotated to adjust the pressure applied to the display envelope (102) by the drive belts (18) under action of the respective undulating leaf springs (26).

In order to provide for a continuous and seamless passage of display envelopes (102) through the display area (15), the display apparatus (1) includes engagement means for sequentially drawing successive display envelopes through the outlet (103) of the storage compartment (101). The engagement means are hook formations (40 and 41) located, respectively, on the leading and trailing edges of each display envelope (102). The leading and trailing hook formations (40 and 41) are adapted to cause the trailing hook of a display envelope to engage the leading hook of a different display envelope as it passes through the outlet (103) of the storage compartment (101).

Figure 7B:
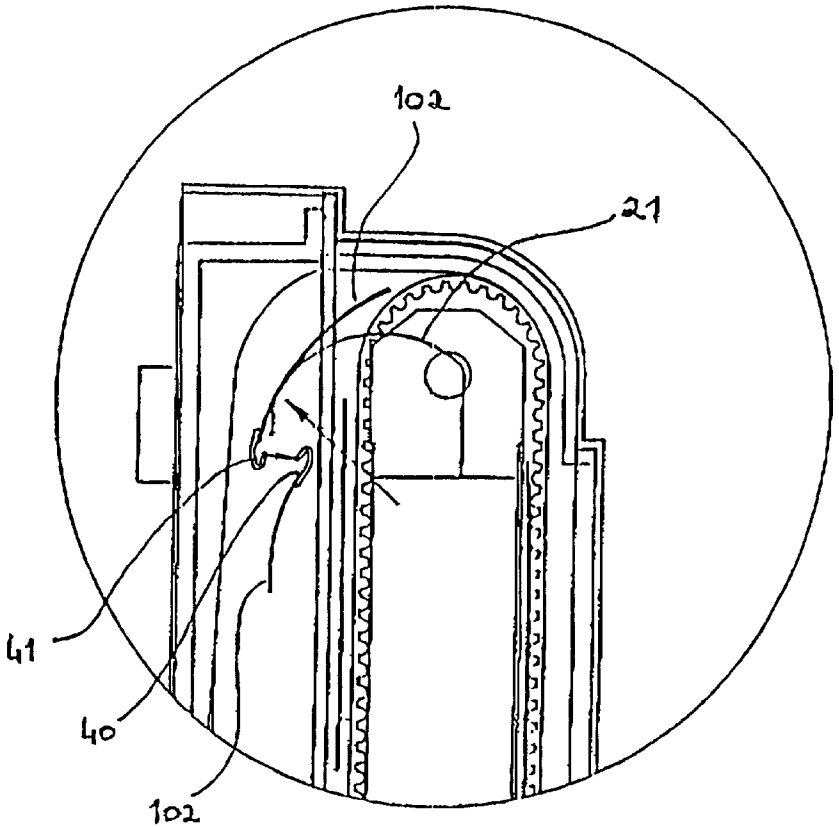
FIGS. 7*a* and 7*b* represent two sequentially linked display envelopes entering the inlet of the storage compartment of the display apparatus of FIG. 1 and a mechanism for effecting their disengagement.
Figure 7A:
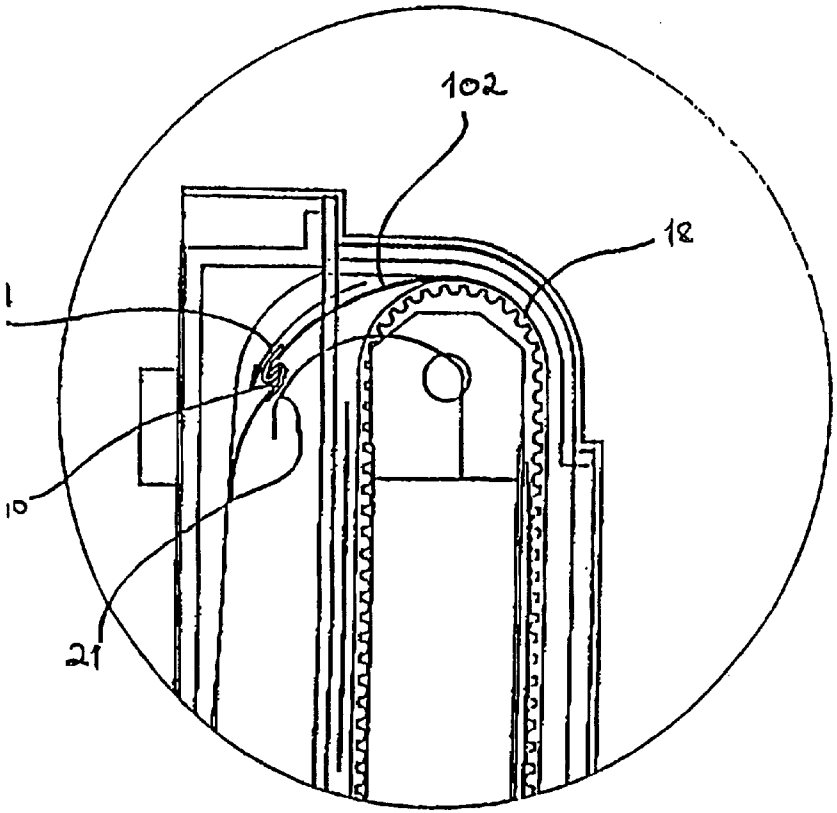
Figure 11:
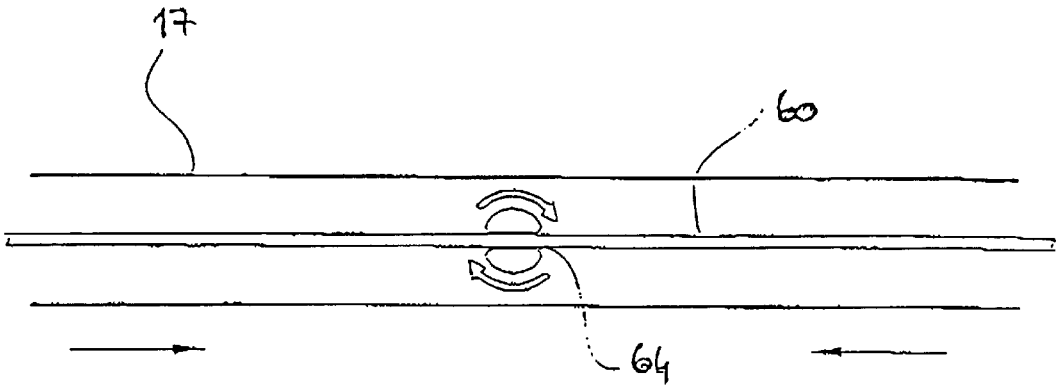
FIG. 11 is a representation of a tensioner of the pressure equalisation assembly of FIG. 10.

A sequential representation of the engagement of the leading and trailing hooks (40 and 41) of two sequential display envelopes (102) at the outlet (103) of the display apparatus (100) is shown in FIGS. 7*a,* 7*b* and 7*c*. The leading hook (40) of a display envelope is held up by a flexible brush (10) at the outlet (103) of the display apparatus. The immediately preceding display envelope (102) is drawn outwardly through the outlet (103) until its trailing hook (41) engages the leading hook (40). The hooks (40 and 41) are shaped to cause an anal force to draw them into closer engagement as shown in FIGS. 13*d* and 13*e*. Once engaged in this manner, the force exerted by the drive belts (18) on the preceding display envelope (102) draws the engaged hooks (40 and 41) through the resistance caused by the flexible brush (10), thereby drawing the succeeding envelope (102) through the outlet (103) of the storage compartment (101).

The display apparatus (100) includes disengagement means (21) in the form of an elongate spring member of substantially arcuate cross-section located at the inlet (104) of the storage compartment (101). The spring member (21) is shaped to deflect adjacent display envelopes (102) entering the storage compartment, thereby facilitating disengagement of the engaged leading and trailing hooks (40 and 41) of the successive display envelopes, as the leading display envelope is held up in the storage compartment whilst the trailing display envelope is still driven out of the display area under action of the drive means.

The display envelope (102) comprises two rectangular sheets (30 and 31) of a flexible transparent antistatic material which is ultrasonically welded together at opposing ends (33) thereof and which has the leading and trailing hooks (40 and 41) secured, respectively, to the welded ends of the envelope.

Figure 5:
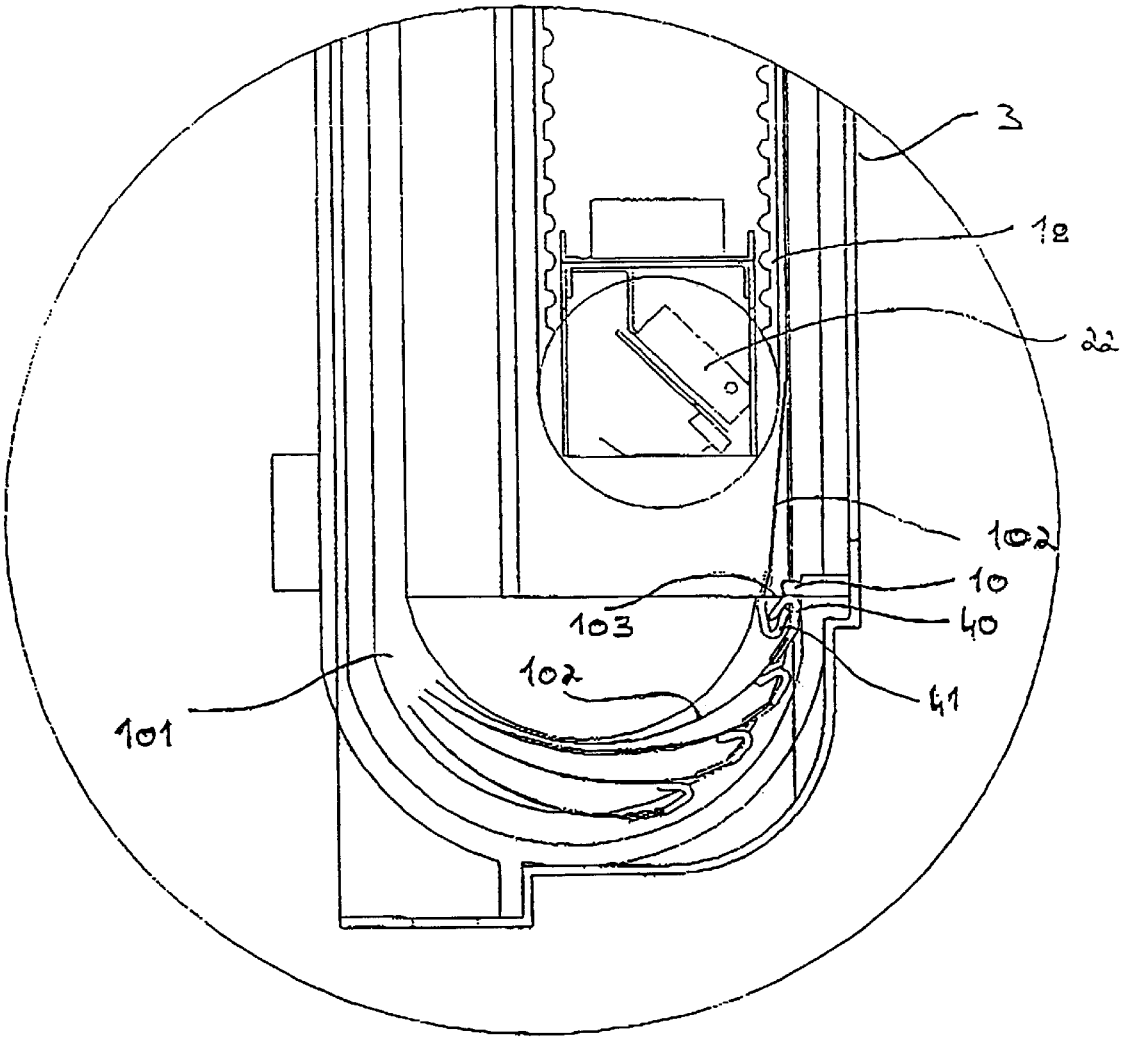
FIG. 5 is a sectional elevation of the outlet portion of a storage compartment of the display apparatus of FIG. 1.
Figure 6:
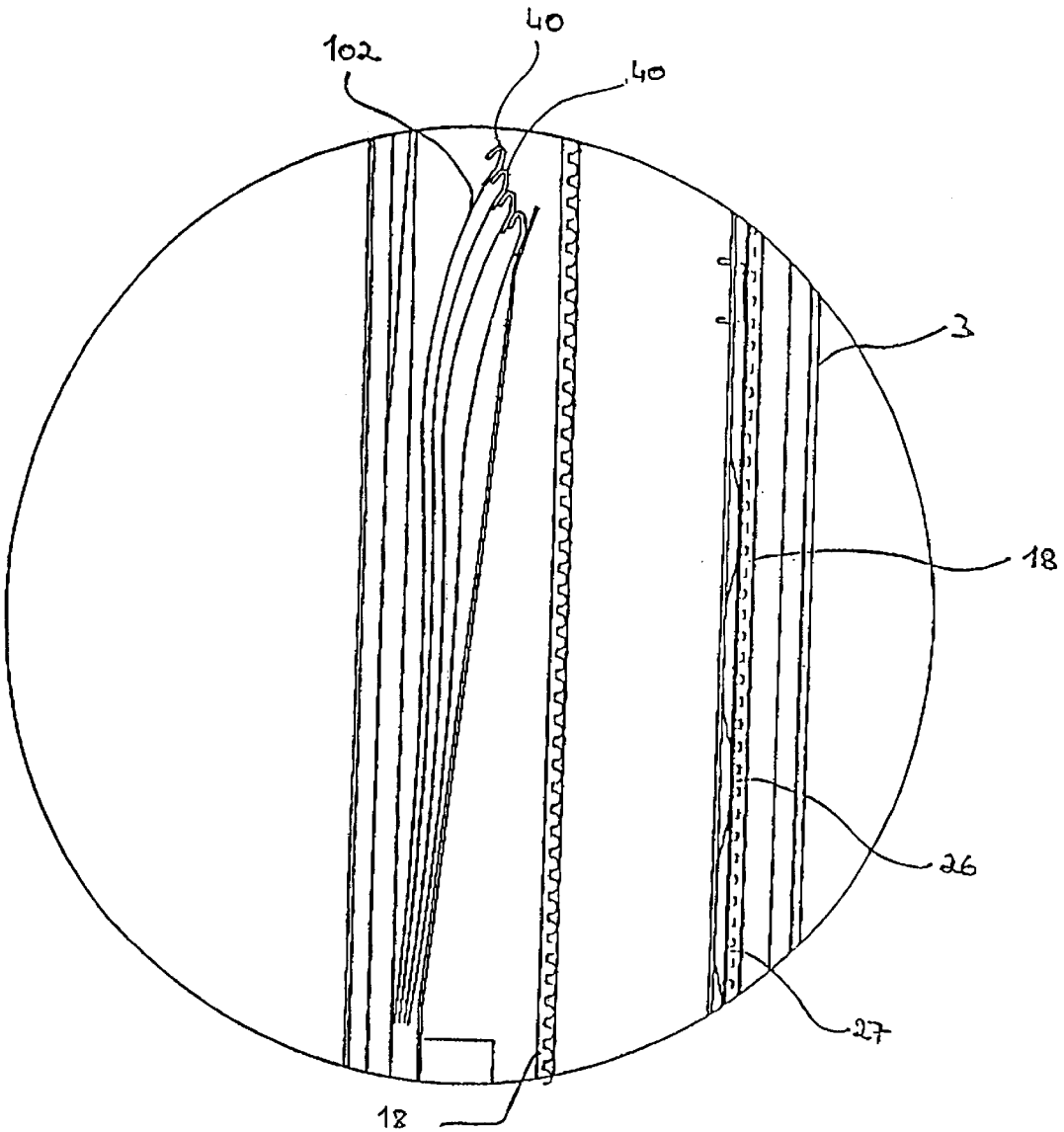
FIG. 6 is a sectional elevation of a number of display envelopes located in the storage compartment of the display apparatus of FIG. 1.

In use, advertising material is placed between the top and bottom sheets (30 and 31) of a plurality of display envelopes (102). The display envelopes loaded in this manner are then inserted into the storage compartment (101) of the display apparatus where they are held in a substantially parallel configuration as indicated in FIG. 6. The storage compartment is curved in the vicinity of its outlet (103) to cause the leading edges of the display envelopes (102) in the storage compartment to be held in a fanned out configuration as represented in FIG. 5.

In order to prepare the apparatus (100) for use, a number of display envelopes are loaded into the storage compartment (101). With the front cover of the display apparatus (100) in an open position, the leading display envelope (102) is drawn partway through the outlet (103) of the storage compartment (101). The leading edge of this display envelope is fed between the drive belts (18) and the front cover, whereupon the front cover of the display apparatus is closed and the motor (14) activated to transport the display envelope into the presentation area (15).

As the trailing hook (41) of the leading display envelope (102) exits the outlet (103) of the storage compartment (101), it engages the leading hook of an adjacent display envelope and draws this envelope out of the storage compartment and through the presentation area as described above.

The leading display envelope (102) is transported by the endless drive belts (18) through the inlet (104) of the storage compartment (101), drawing the succeeding display envelope behind it whereupon the leading and trailing hooks (40 and 41) of these display envelopes are disengaged by the disengagement spring member (21).

The display apparatus (100) includes a programmable timer (110) which can be configured to selectively stop the electric motor (14) for predetermined time intervals to enable the display envelopes (102) to be each displayed in the presentation area (15) for desired time intervals. The display time interval is encoded on the display envelope and is read by an associated reader (22).

It will be appreciated by those skilled in the art that the drive mechanism, the engagement and disengagement means and the tensioning system of the invention combine to increase the reliability of the display apparatus (100) over prior art equivalents.

Figure 14:
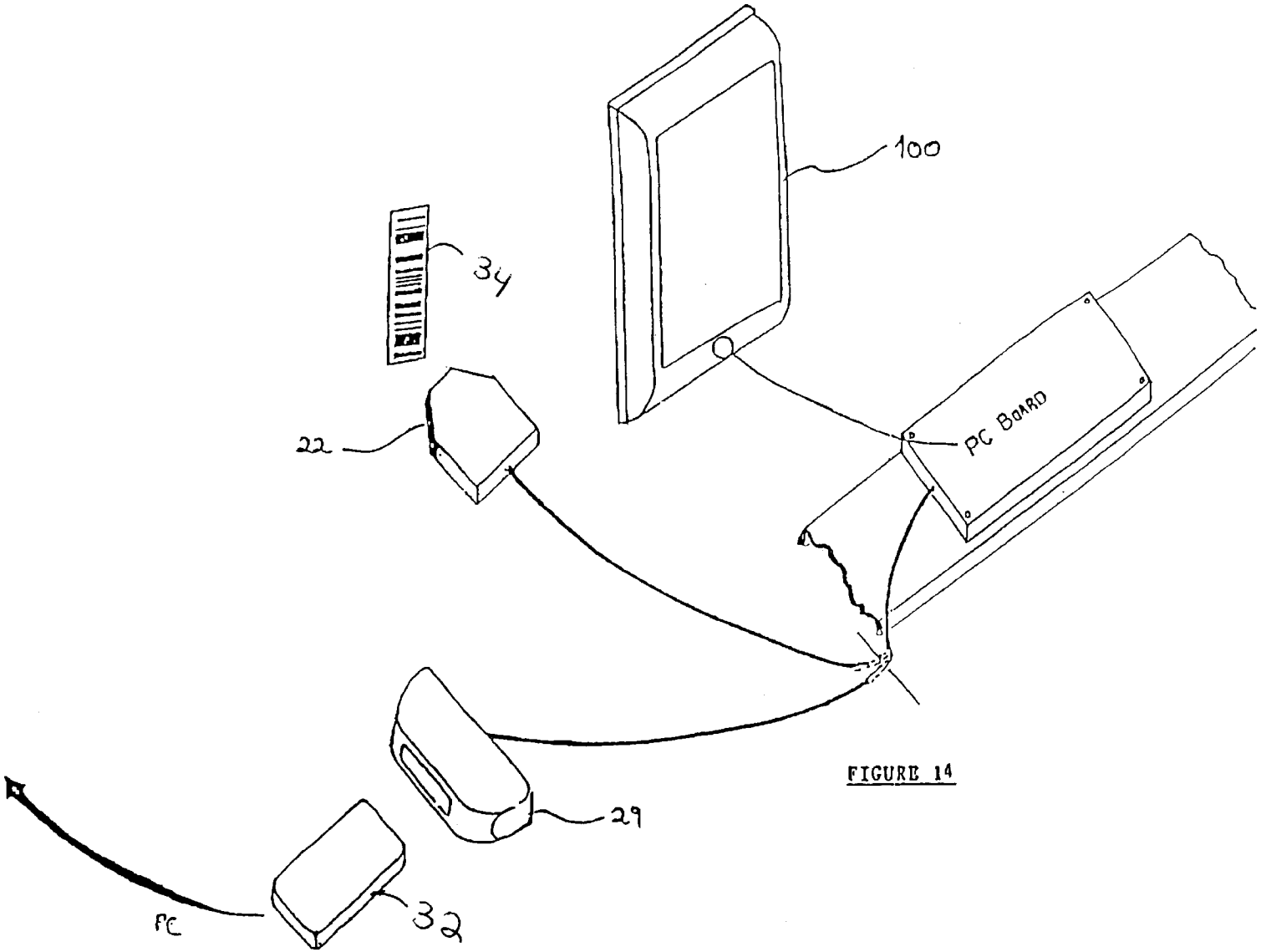
FIG. 14 is a schematic representation of a system for displaying advertising material including the display apparatus of FIG. 1.
Figure 15:
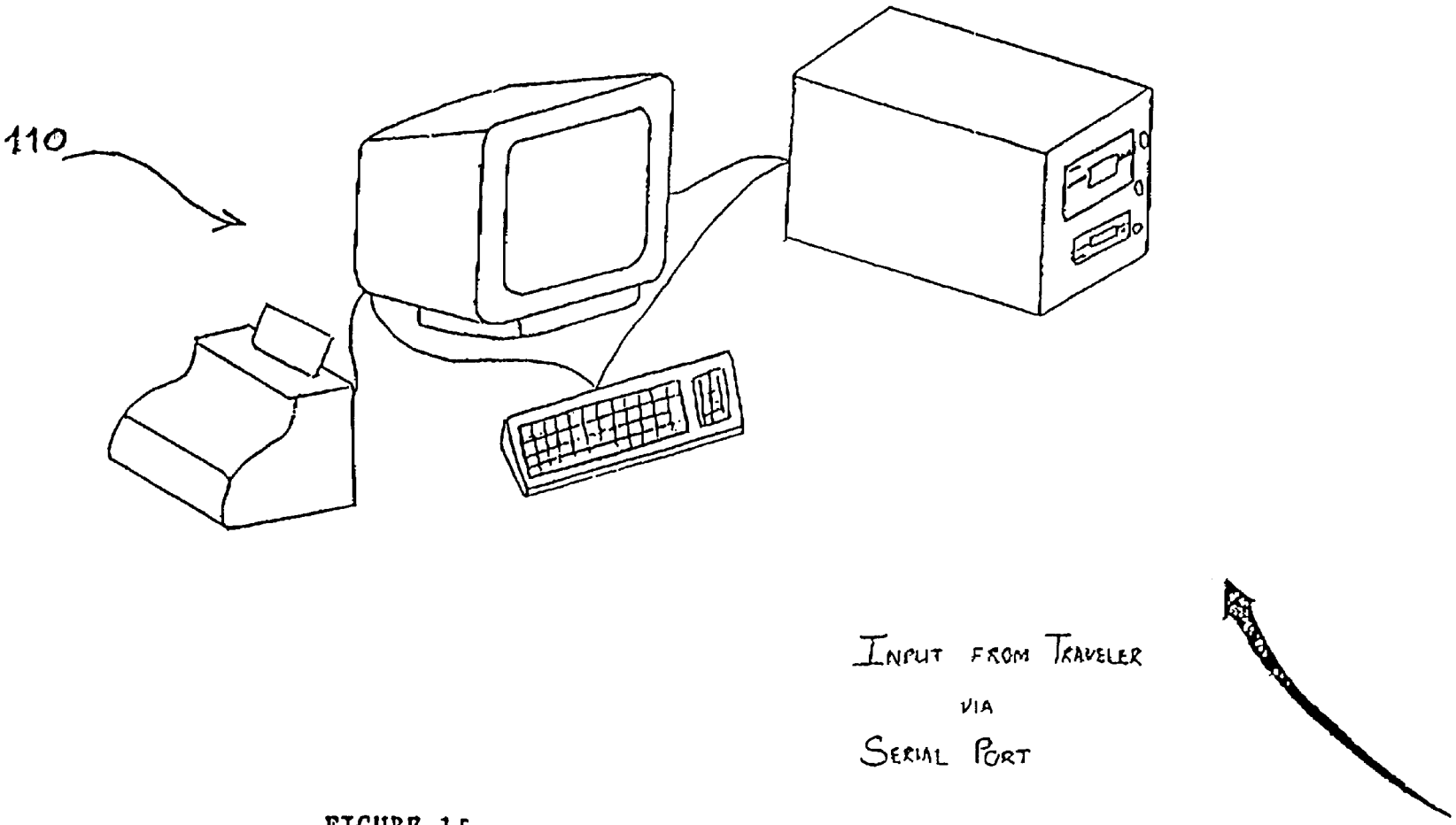
FIG. 15 is a schematic diagram of a billing facility for use with the system for displaying advertising material of FIG. 10.
Figure 16:
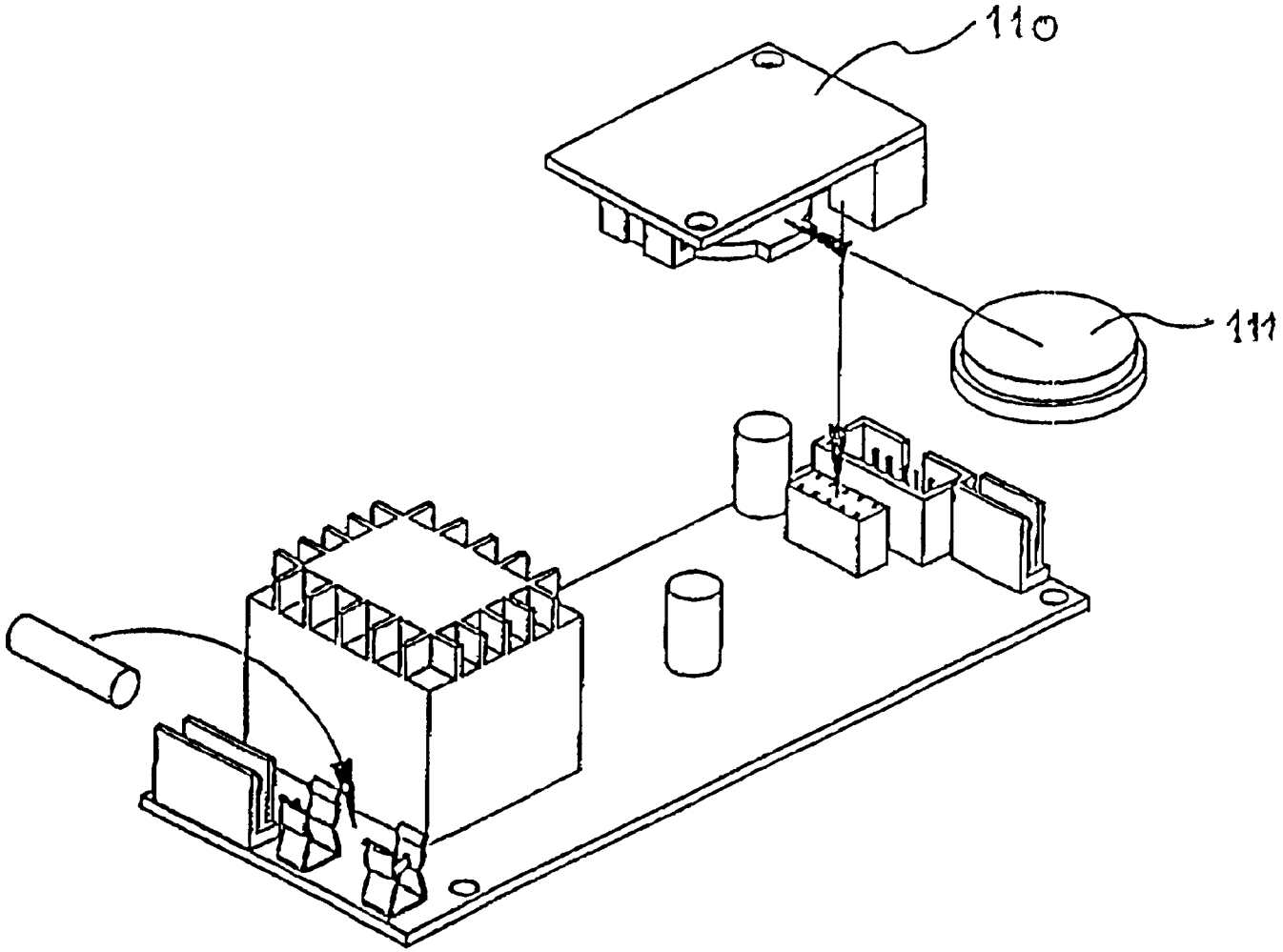
FIG. 16 is a perspective view of a controller module of the display apparatus of FIG. 1.

One or more of the display apparata (100) may be conveniently employed in a system to provide accurate billing information to advertisers according to the actual exposure provided to their respective advertising material. Such a system is indicated in FIGS. 14 and 15.

In this embodiment, each display envelope (102) is marked with a unique identification code (34) in the form of a bar code representing, inter alia, the identity of the advertiser whose advertising material is contained in the display envelope, as well as the time period for which the particular display envelope is to be displayed in the presentation area (15).

The display apparatus (100) is equipped with a reader (22) in the form a bar code scanner for scanning the bar code (34) on the display envelope (102) when it is positioned in the presentation area. The display unit is also equipped with a real time clock (110) powered by a battery (111).

In use, the bar code (34) on a display envelope (102) is scanned by the bar code scanner (22) when the display envelope is positioned in the presentation area (15). The unique bar code is decoded to determine the identity of the advertiser whose advertising material is contained in the display envelope as well as the time period for which the display envelope is to be displayed in the presentation area. The electric motor (14) is deactivated to allow the required time of presentation to be executed, whereupon the advertiser's identity, as well as the date, time and duration of the presentation of the advertiser's material is stored away in a storage means such as random access memory (not shown).

Optionally, the display apparatus (100) may include a sound facility such as a speaker, and for the unique bar code to enable the initiation of an advertising jingle played through the speaker when the display envelope (102) is positioned in the presentation area, thereby providing a multi-media facility.

It is envisaged that each display apparatus (100) in the system includes a communication bus (29) to enable downloading of the stored information to a portable storage facility (32) which is connectable to a billing facility such as a computer system represented generally by numeral (110) for transferring the download information thereto.

Numerous modifications are possible to this embodiment without departing from the scope of the invention. For example, the unique identification code may be contained in a semiconductor passive transponder chip which is secured to a display envelope for reading by an associated reader. Further, the display apparata (100) of the system may be permanently connected to the billing facility (110) by means of a communication bus (29) to facilitate the transfer of stored information thereto. Still further, an audible alarm system consisting of a motion sensor and a siren may be included within the display apparatus (100) to deter theft.

The invention therefore provides a display apparatus for displaying advertising material which possesses improved reliability over prior art equivalents and which facilitates the provision of itemised billing information to advertisers.

What is claimed is:

1. A display apparatus (100), including:

a chassis frame (17) and a housing defining a storage compartment (101) for storing a plurality of display envelopes in a substantially parallel configuration, the storage compartment having an inlet (104) and an outlet (103);

drive means for drawing a display envelope (102) along a predetermined trajectory through a presentation area (15) and into the inlet of the storage compartment;

lighting means (5) for back-lighting the display envelope whilst positioned in the presentation area; and engagement means (40,41) for sequentially drawing successive display envelopes through the outlet of the storage compartment characterised in that the drive means includes at least one endless drive belt (18) locatable over a pair of rollers spaced away from each other at opposing ends of the chassis frame, the endless belt having a bearing face (25), and at least one undulating leaf spring (26) secured to the chassis frame for urging the bearing face of the endless drive belt against the surface of the display envelope whilst located at least partially in the presentation area.

2. A display apparatus as claimed in claim 1 which includes two endless drive belts (18) in a parallel configuration arranged to bear on opposing ends of the display envelopes (102) in a direction parallel to an intended direction of travel of the display envelope.

3. A display apparatus as claimed in claim 1 in which the bearing faces (25) of the endless drive belts are silicon-coated.

4. A display apparatus as claimed in claim 2 which includes a pressure equalisafion assembly (60) for equalising the pressure applied by the bearing faces (25) of the drive belts (18) on the opposing ends of the display envelope (102).

5. A display apparatus as claimed in claim 4 in which the pressure equalisation assembly is a cable (60) securable to the chassis frame (17), the cable being connected at either end (61*a*,61*b*) to a corresponding one of the undulating leaf springs (26).

6. A display apparatus as claimed in claim 5 in which the cable (60) is co-operable with a tensioner (63).

7. A display apparatus as claimed in claim 1 in which the engagement means are hook formations (40,41) located on operatively leading and trailing edges, respectively, of the display envelopes (102) relative to the intended direction of travel.

8. A display apparatus as claimed in claim 7 in which the trailing hook (41) of a display envelope (102) engages the leading hook (40) of an adjacent display envelope as it passes through the outlet (103) of the storage compartment (101).

9. A display apparatus as claimed in claim 8 which includes disengagement means (21) for disengaging the leading and trailing hooks (40,41) of successive display envelopes (102) upon entry to the storage compartment (101) through the inlet (104) thereof.

10. A display apparatus as claimed in claim 9 in which the disengagement means (21) is an elongate spring member (21) of substantially arcuate cross section locatable at the inlet (104) to the storage compartment (101), the spring member being adapted to deflect the display envelopes (102) and to cause disengagement of the engaged leading and trailing hooks (40,41) of successive display envelopes.

11. A display apparatus as claimed in claim 1 in which the storage compartment (101) is curved in the vicinity of the outlet (103) to cause the leading edges of a plurality of display envelopes (102) in the storage compartment to be held in a fanned-out configuration.

12. A display apparatus as claimed in claim 1 which one of the rollers is driven by a motor (14).

13. A display apparatus as claimed in claim 12 in which the motor (14) is an electric motor.

14. A display apparatus as claimed in claim 1 in which the lighting means is a plurality of fluorescent tubes (5) located on an operatively front wall of the storage compartment (101).

15. A display envelope (101) for use with a display apparatus (100) as claimed in claim 1, including two rectangular sheets (30,31) of a flexible transparent antistatic material ultrasonically welded together at opposing ends (33), and having a leading and a trailing hook (40,41) secured, respectively, to the welded ends of the envelope.

16. A system for displaying advertising material, comprising: at least one display apparatus (100) adapted to sequentially position a plurality of display envelopes (102) containing the advertising material in a presentation area (15) for a predetermined period of time, each display envelope bearing a unique identification code (34); a reader (22) for reading the unique identification code on a display envelope when it is positioned in the presentation area; a real time clock (110); and storage means for storing the unique identification code of each display envelope when it is positioned in the presentation area, and the length of time for which it is present in the presentation area.

17. A system as claimed in claim 16 in which the unique identification code (34) indicates the identity of an advertiser whose advertising material is contained in the display envelope (102).

18. A system as claimed in claim 16 in which the identification code (34) represents the time period for which the display envelope is to be displayed in the presentation area.

19. A system as claimed in claim 17 in which the identification code (34) is a bar code.

20. A system as claimed in claim 19 in which the reader (22) is a bar code scanner.

21. A system as claimed in claim 16 which includes a sound facility.

22. A system as claimed in claim 21 in which the unique identification code (34) selectively initiates the playing of an advertising jingle through the sound facility when the display envelope (102) is positioned in the presentation area.

23. A system as claimed in claim 21 in which the sound facility is a speaker.

24. A system as claimed in claim 16 in which the display apparatus (100) includes a communication bus (29) for downloading the stored information to a billing facility for preparing itemised bills for advertisers whose advertising material is displayed in the display apparatus.

25. A system as claimed in claim 24 which includes a portable storage facility connectable to the communication bus (29) for storing downloaded information.

26. A system as claimed in claim 25 in which the storage facility is connectable to the billing facility (110) for transferring the downloaded information thereto.

27. A system as claimed in claim 24 in which the billing facility (110) is a computer.

* * * * *

UNITED STATES PATENT AND TRADEMARK OFFICE

CERTIFICATE OF CORRECTION

PATENT NO. : 6,505,427 B1 
DATED : January 14, 2003
INVENTOR(S) : Paul Sterling and Ignace M. G. J. Van Goethem It is certified that error appears in the above-identified patent and that said Letters Patent is hereby corrected as shown below:

Title page,
Item [57], ABSTRACT,
Lines 10 and 15, after "envelope", delete "while" and insert -- whilst --.

Column 2,
Line 2, delete "difficult";
Line 3, after "curved", delete "In" and insert -- in --.
Line 32, after "means", delete "Includes" and insert -- includes --.

Column 7,
Line 67, delete "characterized in that" and insert -- wherein --.

Column 8,
Line 6, after "the", and before "endless" insert -- at least one --;
Line 25, after "a", delete "corresponding" and insert -- respective --;
Line 32, after "(102)", insert -- , --;
Line 35, after "(102)", insert -- is operable to --;
Line 36, after "as", delete "it" and insert -- the former display envelope --; and
Line 55, delete "held" and insert -- arranged --.

Signed and Sealed this

Seventeenth Day of June, 2003

JAMES E. ROGAN
*Director of the United States Patent and Trademark Office*